United States Patent [19]

Abderhalden et al.

[11] Patent Number: 4,624,020

[45] Date of Patent: Nov. 25, 1986

[54] SINK UNIT PARTICULARLY HOUSEHOLD KITCHEN SINK UNIT

[75] Inventors: Herbert Abderhalden, Rothrist, Switzerland; Duncan B. Marr, Wilmslow, Great Britain; Ivan Heimann, Egerkingen; Jürg Schmid, Kilchberg, both of Switzerland

[73] Assignee: Niro-Plan AG, Zug, Switzerland

[21] Appl. No.: 754,589

[22] Filed: Jul. 15, 1985

[30] Foreign Application Priority Data

Sep. 6, 1984 [DE] Fed. Rep. of Germany ..... 3432695

[51] Int. Cl.[4] ..... E03C 1/24

[52] U.S. Cl. ..... 4/651; 4/637; 4/639; 4/640; 4/653

[58] Field of Search ..... 4/640, 642, 651, 619, 4/637, 650, 653, 643, 661

[56] References Cited

U.S. PATENT DOCUMENTS

| | | | |
|---|---|---|---|
| 692,706 | 2/1902 | Poate | 4/640 |
| 942,014 | 11/1909 | Schneider et al. | 4/640 |
| 1,028,327 | 6/1912 | Carter | 4/651 |
| 2,028,802 | 1/1936 | Ottke | 4/640 X |
| 2,063,243 | 12/1936 | Groeniger | 4/642 |
| 2,189,372 | 2/1940 | Stangebye | 4/642 |
| 2,334,293 | 11/1943 | Stein | 4/642 |
| 3,314,082 | 4/1967 | Minella | 4/651 |
| 3,859,675 | 1/1975 | Van Manen et al. | 4/651 |

*Primary Examiner*—Henry K. Artis

*Attorney, Agent, or Firm*—Frishauf, Holtz, Goodman & Woodward

[57] ABSTRACT

To provide for positive sanitary separation of water spilling or overflowing from a washing sink unit (1), a cleaning sink unit (2) and a third water receiving unit (3), which may be formed as a sink unit or as a drain board, the second unit, located between the first and the third, is surrounded by a raised zone which merges with a forward region of a water retention rim (4) surrounding all the sink units, the raised region (5) terminating short of the rear edge region (19) of the sink unit, and leaving with the water retention rim (4) adjacent the rear edge region a gap (7). A drain and overflow opening (8) is located in the gap. Surfaces of the sink which may be essentially planar are pitched towards the overflow and drain opening, so that any water splashing or overflowing from any one of the three units or regions (1, 2, 3) will drain off into the overflow without flowing back into another one of the units or regions.

16 Claims, 6 Drawing Figures

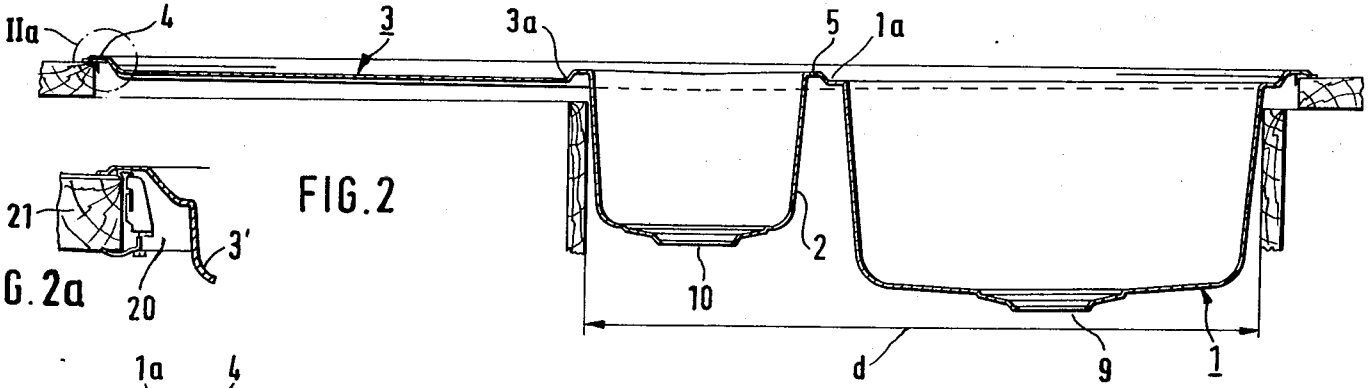
FIG. 2
FIG. 2a
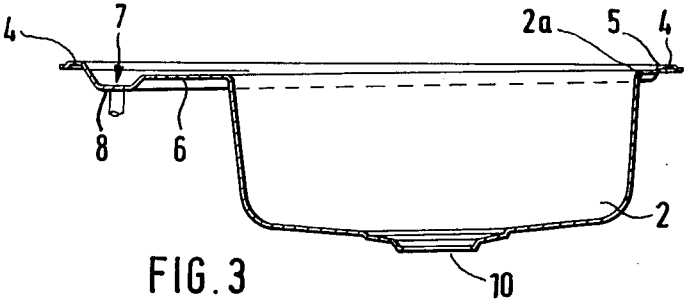
FIG. 3
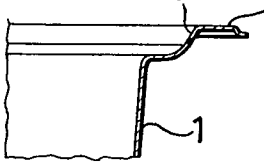
FIG. 5
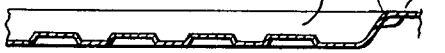
FIG. 4

SINK UNIT PARTICULARLY HOUSEHOLD KITCHEN SINK UNIT

Reference to related patents, assigned to a company within the corporate structure of the assignee of the present application: German Patent Publication Document No. 25 00 337, published July 8, 1976; German Patent No. 27 46 697, first published Apr. 19, 1979; French Publication "Techniques & architecture", 1964, vol. 3. p. 45; Descriptive literature of sink models "Compact" and "Compact Soft" issued by the assignee of the present application.

The present invention relates to a sink unit, and more particularly to a household kitchen sink, and especially to a household kitchen sink which has a triple division, one of the divisions providing a main wash or rinse sink, another division, substantially narrower than the main division, forming a washing and cleaning sink, and a third division which may be a further sink unit or constructed flat as a drain board.

BACKGROUND

Various types of sink units of the character described have been proposed, and particularly sink units which have two main compartments, one forming a washing or main working sink, the other a rinsing sink or a zone for a drain board; alternatively, a rinsing sink may be provided with a drain board cover slidable thereover, for example to support a dish drainer or the like. Such sinks usually have a splash guard or water retention rim, which is raised above the upper edge of the respective sinks or drain board, to prevent spilled water from running over the edge and, for example, dripping on the floor.

The third division of the sink unit as a whole, which may be a further sink or a drain board or a sink with a drain board fitted thereover, for selective use as a sink or drain board will, hereinafter in the specification and claims, be referred to as a "water receiving zone or region"—unless otherwise described, since, selectively and according to demand of the customer, a solid drain board, a removable drain board or a sink may be installed in that zone or region, each one of them, however, having the function of reception of water.

Sinks of the type described have been provided by the assignee of the present application and sold under the terms "Compact" and "Compact Soft", respectively. The narrower or cleaning sink unit is located centrally between the main wash sink and the water receiving region. A raised region is located in front as well as behind the washing and cleaning sink unit. One of those regions may be constructed with suitable openings to receive a spout and valve, and the associated control handle or handles of a faucet assembly.

Other types of sinks have been proposed in which a very narrow cleaning sink unit is provided functioning, essentially, only as a drain for waste or garbage products, so that it can hardly be used for any purpose other than disposal of liquid waste and the like, e.g. coffee grinds, rinse water from bottles, etc. (see the referenced French Publication "Technique & architecture", and German Patent Disclosure Document DE-OS No. 25 00 337).

The sinks so far described have one advantage: They provide for hygienic separation of various working regions: A washing sink unit and a drying or dripping region or zone, which are so arranged that water dripping off the drying or dripping zone will not drip into the washing sink unit. If the drying or dripping zone or region is used for cleaning, water running off the zone will not run into the main washing sink unit to contaminate water therein or other articles therein; conversely, water which might run over from the main sink unit cannot reach over into the water receiving zone to soak or at least partially immerse or otherwise contaminate dishes which might already have been washed and are stacked there, for example for drying.

The separation of the working regions is completed by providing a separate drain for the water receiving zone. The main sink unit is formed with the customary overflow opening or drain therefrom, at a high elevation with respect to the bottom of the sink unit, which, also, provides for venting to prevent possible syphoning action, if the sink is installed in a multi-story apartment building, for example. The separate drain, and the overflow—which is required by some governmental building and sanitary codes—insure that water from the water receiving zone can reach the central working or drainage region or unit; likewise, water which might rise in the main sink unit—for example due to inadvertent failure to shut off a water supply spout—cannot overflow into the central sink unit. This is particularly important if, for example, the central sink unit has been filled with clear, clean water, for example in order to rinse glasses, already washed in the main sink unit.

Sink units as described, although having numerous advantages, are comparatively expensive and, further, require comparatively expensive installation, since four drain and/or vent connections must be formed on the sink unit and, thereafter, connected.

THE INVENTION

It is an object to improve a sink unit so that it can be made more inexpensively, meets the highest requirements of sanitation and separation of water content in the various units or regions, and provides for eacy, clearly separated accessibility of the different sink units for ready use thereof in connection with customary household chores.

Briefly, the sink unit has a first or main wash sink region, a second and smaller cleaning sink region, and a third water receiving region which may be formed as a drain board, a further sink, or a sink with a built-in fitting drain board thereover. A water retention rim surrounds all of the outer edges of the sink units or regions, to prevent water splashing or overflowing from anyone of them from flowing behind the sink unit or to the floor. The second or cleaning wash sink unit or region is, preferably, located between the first and the third, and has a width substantially smaller than that of the first and the third, a depth which may be similar to that of the first or main wash sink unit, and a length, front-to-back, somewhat but not substantially less than the length of the first and third regions, respectively.

In accordance with a feature of the invention, a raised zone surrounds the rim of the second or smaller or cleaning washing sink, the raised zone merging with the water retention rim at the forward edge, and being spaced from the water retention rim at the rear edge, leaving a gap between the raised zone and the water retention rim at the back. The upper surface of the sink unit in the region of the gap extends not more than the upper edge of the third or water receiving region. An overflow drain opening is located in the gap.

By providing an overflow opening in the region of the gap, the sink has the advantage that water which might overflow from any one of the three regions, namely the main washing sink, the cleaning sink, or the water receiving region, can all drain into the single overflow, yet, by slightly pitching the sink portions from the respective zones or regions towards the overflow, water which flows from any one of them cannot reach into another. Thus, a separate overflow in the main wash basin becomes unnecessary, without, however, losing the advantage of hygienic separation of water flow between the respective sink regions, while complying with all building and sanitary requirements that an overflow is provided.

The sink has the additional advantage that the overflow opening is not located in the side wall of any one of the sink units, which might, otherwise, provide a location for reinfection of clean water with contaminants which reach the region from a washing sink; rather, the overflow is located beyond any one of the sinks which may carry contaminated water which might leave deposits conducive to bacterial growth. The arrangement, thus, substantially improves hygiene and sanitation in use of the sink.

Attachment for valves, spray heads, and the like, can readily be placed, either on raised positions or flush, on the outer rim; in accordance with a preferred feature of the invention, the raised zone is perforated to accept a customary valve-and-spout valve and spout faucet unit which, for example, may require only one hole, or a further one, for example if a spray tube is also used. It is, thus, possible, to integrate the sink fittings, including valves and handles therefor, in the raised zone. This arrangement also permits shielding or at least visually covering the overflow opening by the portion of the sink fitting located on the raised zone so that the otherwise integrally closed design look of the sink wll be maintained.

Water which might overflow from the main washing sink unit, or from the cleaning sink unit, can be directed rapidly and directly to the overflow opening, by providing a depression, or a channel or downwardly pitched path towards the overflow. Apart from such water-directing surfaces, the end or edge zones of the respective regions are preferably flat and level, so that they can receive grates, covering boards, sliders, or the like.

The water receiving zone, if formed as a sink, for example, or otherwise to receive water, may have its own drain opening, as known in the prior art (see, for example, the referenced German Pat. No. 27 46 697). In accordance with a feature of the invention, however, it is not necessary to provide a separate drain opening, particularly if the water receiving zone is formed as a drain board, since the overflow, located in accordance with a feature of the invention in the aforementioned gap provides for sufficient drainage of water from the water receiving zone, particularly if the water receiving zone is slightly pitched downwardly towards the drainage opening, for example by having an inclination which is at an angle towards the rear, diagonally of the sink, and towards the drainage opening. Usually, if the water receiving zone is formed as a drain board, the upper surface will be ribbed or corrugated; preferably, and in order to assist in direction of water, the corrugation should be directed towards the drainage opening, so that water which drips off washed and rinsed dishes, for example, will automatically drain towards and into the overflow opening.

The surface below the water retention rim may be horizontal, but, preferably, is slightly pitched downwardly towards the overflow opening. The edge zone of the second or cleaning sink unit likewise is preferably pitched towards the overflow opening.

The overflow opening may extend, transversely, over the entire gap between the raised zone and the water retention rim; flow of any overflowing water past the drain overflow opening thus is reliably prevented. It is not necessary, however, to extend the overflow opening throughout the entire gap, since the drain will have some suction effect which will be applied also to further and remotely located regions of waterflow towards the drain opening. A relatively narrow overflow can be used if, for example, the surface of the gap is not formed flat but, rather, trough or channel like.

The overflow itself can be constructed in various ways, for example as a single opening, in form of a plurality of adjacently located openings, arranged grid-like, next to each other, and the like.

DRAWINGS

FIG. 2 is a longitudinal sectional view along line II—II of FIG. 1;

Figure 1:
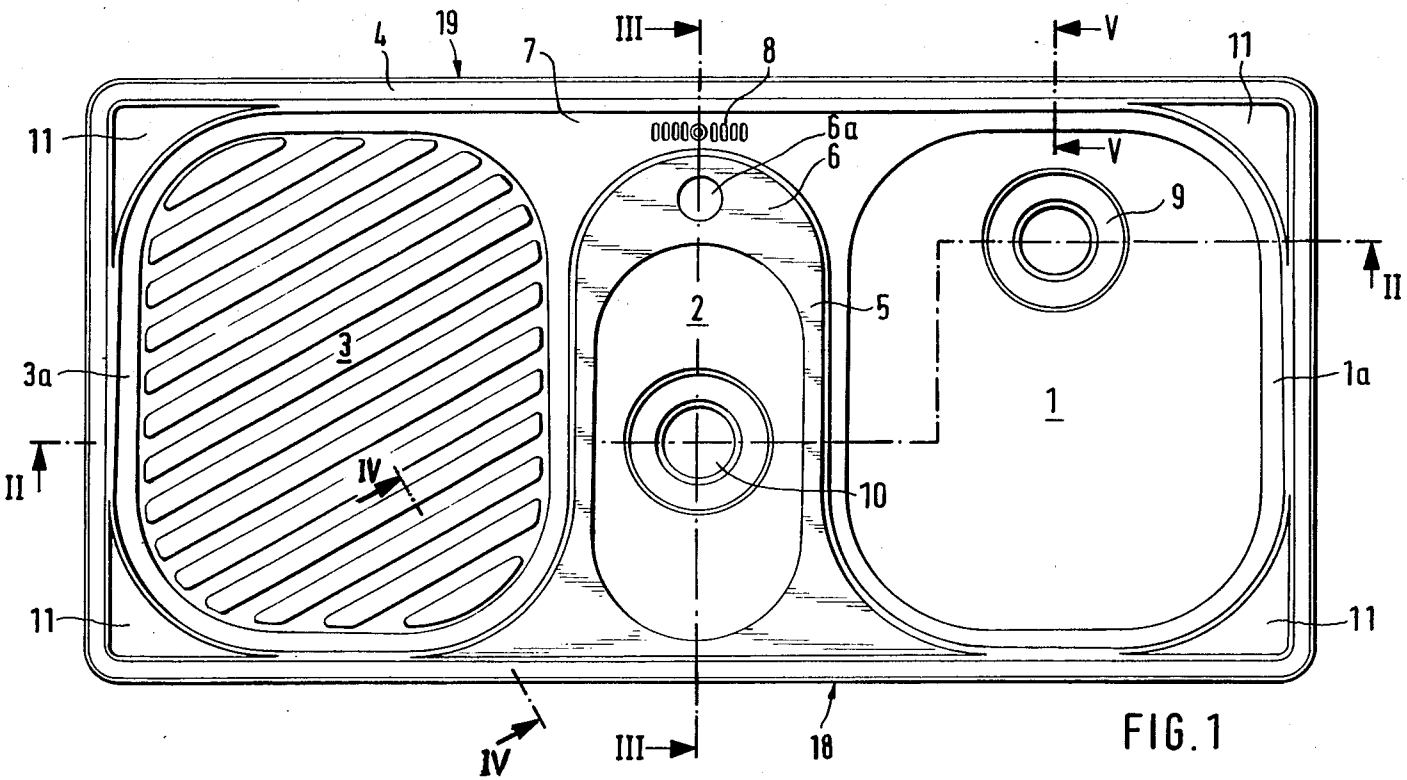
FIG. 1 is a top view of the sink, omitting all features not necessary for an understanding of the invention.

FIG. 2*a* is a detail view within the circle IIa of FIG. 2, and illustrating another embodiment of the water receiving zone;

FIG. 3 is a section along line III—III of FIG. 1;

FIG. 4 is a section along line IV—IV of FIG. 1; and

FIG. 5 is a section along line V—V of FIG. 1.

In the drawings, the sink unit, since it is made, for example, of stamped stainless steel and thus has only minimal thickness, is shown in single-line representation.

DETAILED DESCRIPTION

The invention will be described in connection with a sink unit which has a main or washing sink, a second or cleaning sink, and, in the third or water receiving region or zone, a drain board. Rather than using a drain board, of course, a further sink unit, for example similar to the main washing sink unit, may be used.

The sink illustrated in FIG. 1 has, horizontally aligned, a main or washing sink unit 1, a cleaning sink unit 2, and the drain board or dripping unit 3. The washing unit 1 and the dripping unit 3, seen in top view, have a similar contour; grates, sliding boards, covers and the like, may thus be located, selectively, on either one of the units 1, 3 and will fit thereover. In contrast, the cleaning sink unit 2 is oval, longitudinally extending from front to back, between the two units 1 and 3. In contrast to prior art structures, the cleaning unit 2 extends up to the forward edge region 1*a* of the sink unit. This permits use of the cleaning unit 2 not only for customary cleaning, for example, of vegetables and the like, but it may also be used as a sink unit for washing, that is, to retain soapy water for example.

The entire sink unit is surrounded at the outside by a water retention rim 4, raised over the edge of the sink, as best seen in the sectional views of FIGS. 2–5.

In accordance with a feature of the invention, the upper surface of the sink unit 1 and of the water receiving region 3 does not extend flush over to the cleaning sink 2, but, rather, the cleaning sink 2 is surrounded by a raised zone 5. The raised zone 5 is arranged in form of a rim along the sides of the unit 2 and merges, along the forward edge zone 18, with the water retention rim 4. Towards the rear edge zone 19, the raised zone 5 is continued at a raised level to form a platform 6, suitable for attachment of a faucet fixture, including a spout, valve, and the like. The platform 6 is formed with a suitable attachment opening 6*a* for passage of the connection elements of the faucet structure. The faucet-and-sprout structure can be of any suitable and standard arrangement, as well known in the kitchen plumbing field. In accordance with a feature of the invention, the raised zone 5 is not continued towards the rear region of the water retention rim 4, but, rather, terminates in advance thereof—see FIG. 3—to leave a gap 7. The gap 7, which may be a few centimeters wide, forms a connection for water flow between the upper surface of the main sink unit 1 or the upper surface of the water receiving unit 3 to drain 8. To prevent cross flow or cross contamination, the surface regions, seen on the right and left side of FIG. 1, respectively, are pitched downwardly towards the gap 7. Overflow and drain openings 8 are located at the narrowest and lowest point of the gap 7. The overflow openings—which may, for example, be in grate or grid form, a single opening or the like—insure that water which overflows from either one of the regions or units 1, 2 or 3 will reliably flow out, without being able to penetrate into other units. This has the additional advantage that, for installation purposes, drain openings have to be connected only to a drain 9 from the sink unit 1, a drain 10 from the cleaning sink unit 2 and to the overflow opening 8.

FIG. 2*a* shows a connection of the rim 4, and hence of the sink, to a kitchen counter top 21, for example by using a well known and customary clamp connection 20. FIG. 2*a* also illustrates another modification in that the water receiving unit 3 is shown in form of a sink 3' which, for example, may be the mirror image of the sink unit 1, so that the rims of the sink unit 1 and 3' will both be pitched downwardly towards the drain opening, collectively shown at 8.

The sink in accordance with the present invention has the advantage that the separation of work zones is ergonometrically an optimum, while requiring only one single overflow connection although two or three sink units may be used. Additionally, the overflow connection in the arrangement described is in a hygienically desirable range where it can be easily cleaned and, for example, water dripping off already washed dishes and draining on the region 3 will clean off and decontaminate any possible deposits which may have accumulated due to overflow from the sink unit 1.

The sink unit with a drain board arrangement, as shown in FIGS. 1 and 2, has the additional advantage that it can be placed where a shallow outline is required. Thus, its horizontal dimension where the sink units 1, 2 are located, shown at d, need be no more than 55 cm (about 22 inches), so that it will fit in a standard 24"-cabinet 21. The sink, therefore, is compact and provides for additional under-the-counter space, for example for a dishwasher, compact refrigerator, or the like.

Any water which might overflow from any one of the sink units 1 or 2—and, if provided, from sink unit 3'—will be guided rapidly to the overflow opening. The raised zone or region 5 is extended towards the water retention ring 4 at the forward edge zone 18 of the sink unit. From the forward region, it extends laterally about the rounded zone of the respective units 1, 3. Platforms 11 are located at the four corners of the sink, the platforms 11 being depressed with respect to the water retention rim 4, but above the upper edge of the rim of the respective units 1, 3. The platforms 11 thus insure that any spilled or splashed water will drain back into the respective unit 1, 2 or 3 or directly into the overflow 8; the platforms additionally provide for visually harmonious transition of the corners of the units 1, 3, which have a wider radius than the radii at the corners of the sink unit as such. The upper rim of the unit 1 is shown at 1*a* (FIG. 2), the upper edge of the unit 3 at 3*a*, and the upper edge of the unit 2 at 2*a* (FIG. 3). The upper edge of the unit 2 preferably merges smoothly into the raised zone 5.

We claim:

1. A multi-basin sink unit with a hygenically and visually isolated common overflow drain, particularly a kitchen sink for household use, having a forward edge region (18) and a rear edge region (19);

a first, main wash sink unit or region (1) having an upper rim (1*a*) and a drain (9) therein;

a second wash sink unit or region (2) having a drain (10) therein, the second wash sink region being substantially narrower than the main wash sink region (1);

a third, water receiving region (3) adjacent one of said sink regions (1, 2);

a circumferential water retention rim (4) surrounding the extreme outline of said sink units or regions, and comprising, in accordance with the invention, a raised zone (5) surrounding the upper rim of the second, narrower wash sink unit or region (2), said raised zone (5) merging with the circumferential water retention rim (4) at its forward edge zone (18), said raised zone (5) being spaced from the water retention rim (4) at its rear edge zone (19) and leaving a gap region (7) between the raised zone (5) and the water retention rim (4) at the rear edge zone;

a common overflow drain opening (8) located in said gap region (7) and wherein the maximum elevation of said gap region (7) surrounding said common overflow drain (8) is less than the elevation of a peripheral edge of said third water receiving region or zone (3), less than the elevation of said upper rim (1*a*) of said main sink (1) and less than the elevation of sid raised zone (5) surrounding said second, narrower sink (2), thereby permitting overflow into said common drain (8) from any of said first sink (1), second sink (2), and third water receiving zone (3), while simultaneously preventing cross-contamination therebetween, due to overflow water.

2. Sink unit according to claim 1, further including a water supply connection platform (6), said water supply connection platform being located on the raised zone (5) at the region adjacent the rear edge (19) of the sink unit.

3. Sink unit according to claim 1, wherein the second wash sink region or unit (2) is located between the first and third sink units or regions (1, 3).

4. Sink unit according to claim 3, further including a water supply connection platform (6), said water supply connection platform being located on the raised zone (6) at the region adjacent the rear edge (19) of the sink unit.

5. Sink unit according to claim 1, wherein the region of the raised zone (5) adjacent the rear edge (19) of the sink unit is formed with a water run-off surface pitched towards said overflow and drain opening (8).

6. Sink unit according to claim 4, wherein the region of the raised zone (5) adjacent the rear edge (19) of the sink unit is formed with a water run-off surface pitched towards said overflow and drain opening (8).

7. Sink unit according to claim 1, wherein the overflow opening (8) extends along the length of the unit for a distance of approximately up to the length of said gap.

8. Sink unit according to claim 3, wherein the overflow opening (8) extends along the length of the unit for a distance of approximately up to the length of said gap.

9. Sink unit according to claim 1, wherein said third or water receiving region or unit (3) comprises a drain board diagonally pitched downwardly towards the drain overflow opening (8).

10. Sink unit according to claim 9, wherein the drain board is formed with a corrugated surface;

and wherein the corrugations extend diagonally towards the overflow opening in the direction of the downward pitch of the drain board.

11. Sink unit according to claim 1, wherein the surface zones of said sink regions or units (1, 2, 3) and located in essential alignment with the gap are pitched downwardly towards the drain opening (8).

12. Sink unit according to claim 3, wherein the surface zones of said sink regions or units (1, 2, 3) and located in essential alignment with the gap are pitched downwardly towards the drain opening (8).

13. Sink unit according to claim 1, wherein the raised zone (5) is pitched slightly downwardly towards said gap and said drain opening (8).

14. Sink unit according to claim 3, wherein the raised zone (5) is pitched slightly downwardly towards said gap and said drain opening (8).

15. Sink unit according to claim 3, wherein said third or water receiving region or unit (3) comprises a drain board diagonally pitched downwardly towards the drain overflow opening (8).

16. Sink unit according to claim 15, wherein the drain board is formed with a corrugated surface;

and wherein the corrugations extend diagonally towards the overflow opening in the direction of the downward pitch of the drain board.

* * * * *